US005460589A

United States Patent [19]

Dunn

[11] Patent Number: 5,460,589

[45] Date of Patent: Oct. 24, 1995

[54] RUNNER'S PARACHUTE

[76] Inventor: Joseph P. Dunn, 3555 Atwater Ct., Fremont, Calif. 94536

[21] Appl. No.: 384,431

[22] Filed: Jan. 31, 1995

Related U.S. Application Data

[63] Continuation of Ser. No. 150,844, Nov. 12, 1993, abandoned.

[51] Int. Cl.[6] ..... A63B 21/00

[52] U.S. Cl. ..... 482/111; 482/74

[58] Field of Search ..... 482/111, 74; 280/810; 244/142, 145, 152

[56] References Cited

U.S. PATENT DOCUMENTS

| | | | |
|---|---|---|---|
| 1,178,165 | 4/1916 | Lupton, Jr. | 280/810 |
| 2,018,062 | 10/1935 | Hardt | 280/810 |
| 4,527,794 | 7/1985 | Dunn | 482/111 |
| 4,531,763 | 7/1985 | Toland | 280/810 |
| 4,756,555 | 7/1988 | Bachmann | 280/810 |

*Primary Examiner*—Lynne A. Reichard
*Attorney, Agent, or Firm*—Bielen, Peterson & Lampe

[57] ABSTRACT

An exercise apparatus utilizing a harness or girth which attaches to the central region of a user. A boss extends outwardly and rearwardly from the harness to support a frame member. The frame member is detachably connected to the boss and connected to a sheet or airfoil which is capable of creating air resistance and increases work to the user as the user travels in a certain direction.

7 Claims, 2 Drawing Sheets

FIG. 3
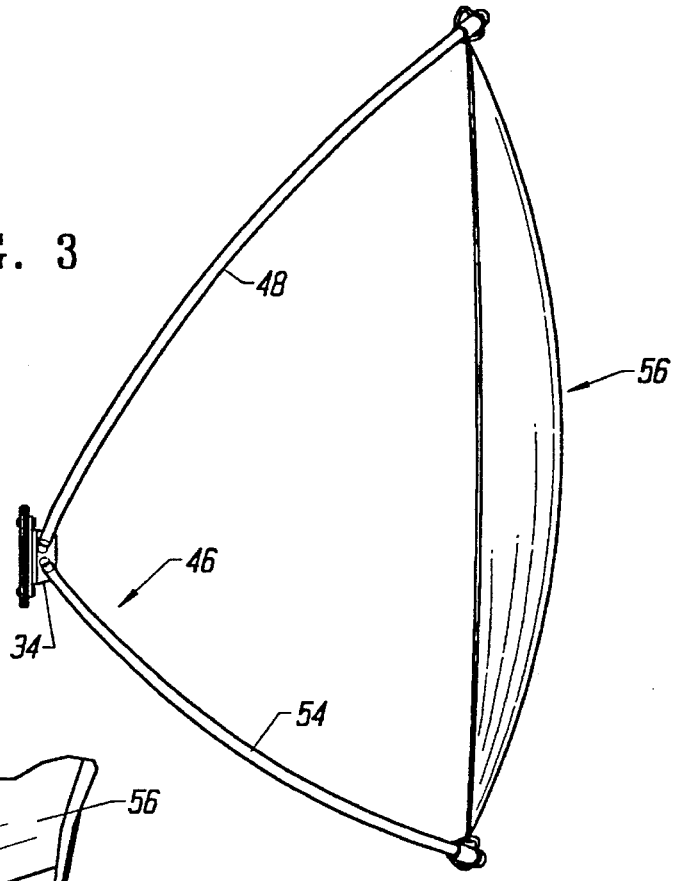
FIG. 6
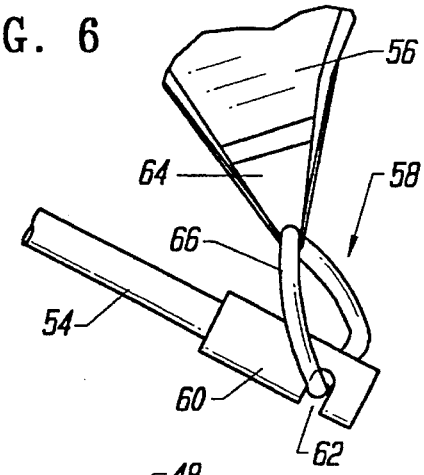
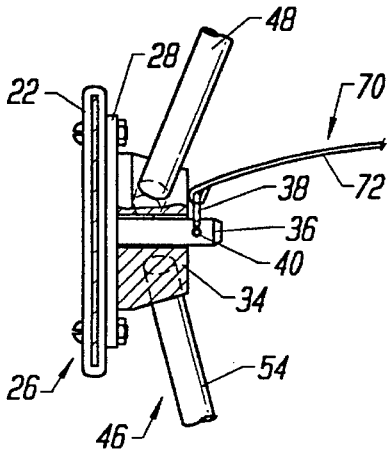
FIG. 4
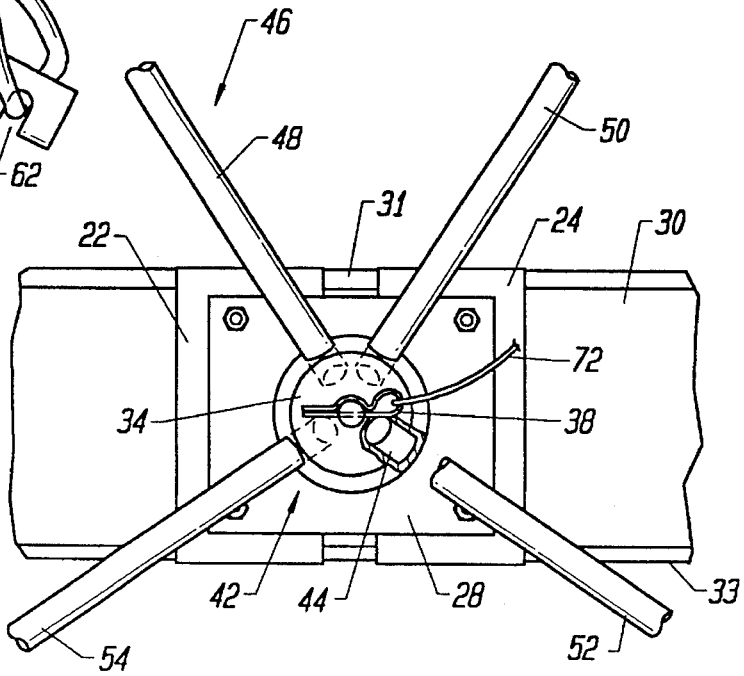
FIG. 5

RUNNER'S PARACHUTE

BACKGROUND OF THE INVENTION

This is a continuation of application Ser. No. 08/150,844, filed 12 Nov. 1993 now abandoned.

The present invention relates to a novel and useful exercise apparatus.

Dynamic exercising usually takes the form of running, walking, cycling, and the like. Persons engaging in such activities measure progress by distances or elapsed time over a certain course of travel. Persons training within a facility such as a stadium, or playing field are often limited by the perimeter of that area. In addition, time constraints require that exercising and training take place within as short a time period as possible, without overtaxing the trainees.

Reference is made to U.S. Pat. No. 4,527,794 which describes a novel wind resistance exercise device. Although successful, the device depicted in this patent requires the user to affix an airfoil by use of a belt and employ a shoulder harness therewith. In addition, reversing the connection procedure of the device is time consuming and difficult, especially in situations requiring disconnection of the device for safety reasons.

An exercise apparatus using air resistance which is easy to attach to the user and disconnect would be a notable advance in the physical training and therapy field.

SUMMARY OF THE INVENTION

In accordance with the present invention, a novel and useful exercise apparatus is herein provided.

The apparatus of the present utilizes a harness which may be in the form of a girth fitted about the waist of the user. The harness would include a cinching mechanism such as a buckle and the like.

A base or boss extends from the harness and may be engaged by a pin extending from a plate connected to the harness. The boss may be constructed with a multiplicity of angled bores that extend backwardly and outwardly relative to the harness.

A frame member is also found in the present invention and is connected or linked to the boss extending from the harness. The frame member may be formed with a plurality of rods or other elongated elements that are held within the multiplicity of bores formed in the boss. Such rods may be detachably held to the boss for the purpose of compactness during storage and shipping of the apparatus of the present invention. Such rods may be flexible and possess a high degree of durability and resilience under bending pressures.

A sheet or airfoil is connected to the frame member and is capable of exerting a force on the harness through the frame member and connected boss. Such force would be generated when the harness is moved due to air resistance on the sheet. The sheet may be connected and disconnected from the frame member with ease.

Locking means is also found in the present invention for detaching the sheet relative to the harness. Such locking means may take the form of providing a clip which is capable of affixing to the pin extending through a portion of the boss. In this manner, removal of the clip would permit the boss, and the connected frame and airfoil, to detach from the pin and the harness. A clip may be attached to a tether which is readily available to the user of the exercise apparatus of the present invention.

It may be apparent that a novel and useful exercise apparatus has been described.

It is therefore an object of the present invention to provide an exercise apparatus which is simple to assemble and transport to a training facility.

It is another object of the present invention to provide an exercise apparatus which utilizes an airfoil or sheet to produce a resistance force which must be overcome by the user's physical effort during walking, running, cycling, and the like.

Another object of the present invention is to provide an exercise apparatus which is relatively simple to manufacture and maintain.

Yet another object of the present invention is to provide an exercise apparatus which utilizes the air resistance of an airfoil and permits the user the freedom of arm motion during such exercising.

Another object of the present invention is to provide an exercise apparatus which allows a person running or walking to engage in such activity in a relatively small geographical area with a high degree of effort.

The invention possesses other objects and advantages especially as concerns particular characteristics and features thereof which will become apparent as the specification continues.

BRIEF DESCRIPTION OF THE DRAWINGS

FIG. 3 is a side elevational view of the apparatus of the present invention.

FIG. 4 is a partial sectional view of the boss supporting a frame member at the rear of the harness.

FIG. 5 is a rear elevational view of a portion of the apparatus of the present invention at the area of the harness to which the boss and frame member are connected.

FIG. 6 is an enlarged partial side view showing the interconnection of the airfoil with the frame member.

For a better understanding of the invention reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments which should be taken on conjunction with the previously discussed drawings.

Figure 1:
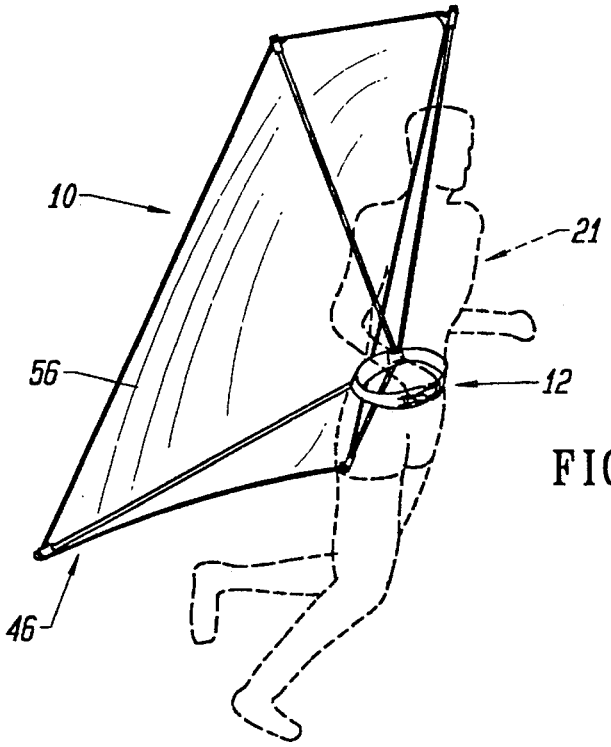
FIG. 1 is a perspective view of the apparatus of the present invention in use on a runner shown in phantom.
Figure 2:
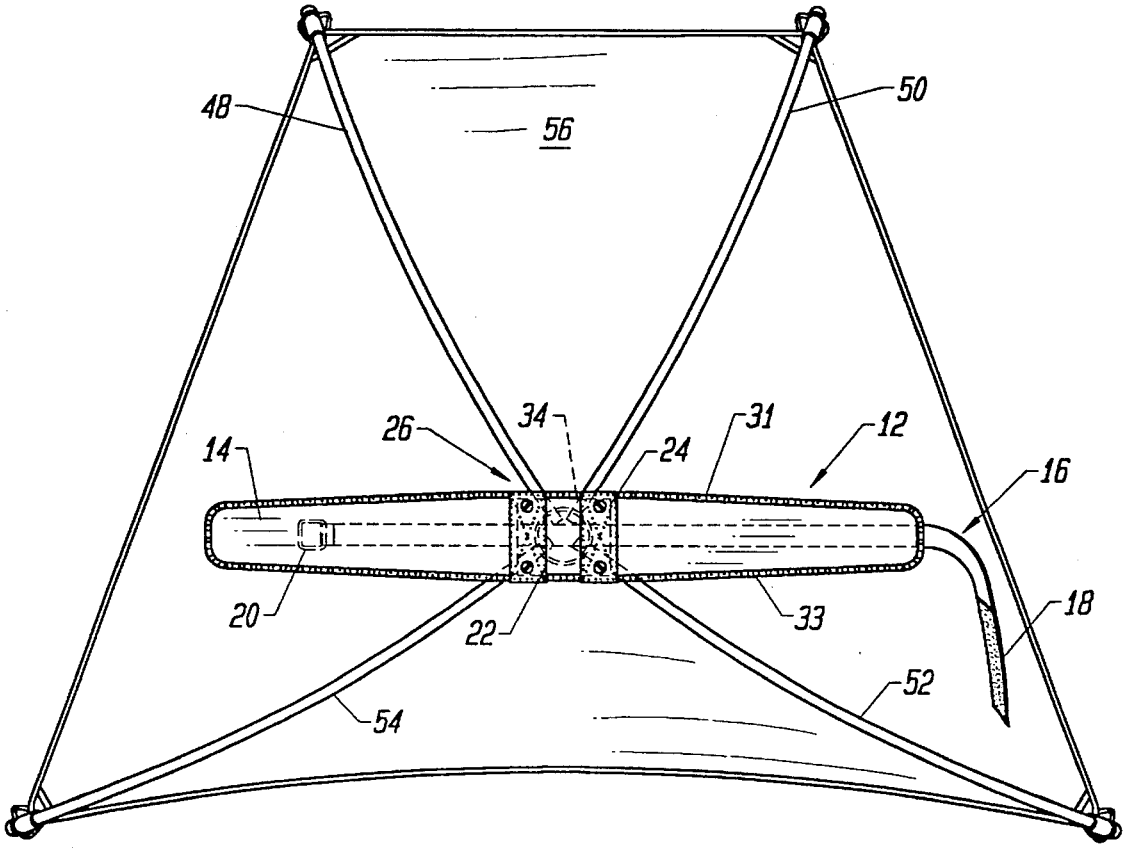
FIG. 2 is a front elevational view of the apparatus of the present invention.

The invention as a whole is depicted in the drawings by reference character 10. The exercise apparatus 10 includes as one of its elements a harness 12, FIGS. 1 and 2. Harness 12 is shown in the form of a band 14 having a belt 16 connected thereto. Belt 16 is formed with a bitter end 18 which is capable of mating with a buckle 20 on another end of belt 16. Thus, harness 12 is generally in the form of a girth which is capable of fitting around the waist of user 21, FIG. 1. Belt 16 permits the cinching of harness 12 to adjust to the size of a particular waist of user 21. Harness 12 is also formed with reinforced encircling loops 22 and 24 which extend around the rear portion of harness 12, as depicted in FIG. 1. Reinforcing loops 22 and 24 may be constructed of any suitable material such as cloth, wood, metal, and the like. A plurality of fasteners 26 extend through loops 22 and 24 to hold a plate 28 along the outer surface 30 of band 14 of harness 12. Salvage portions 31 and 33 extend along the edges of band 14 for the purpose of strengthening the same, FIGS. 4 and 5.

Boss or base 34 lies against plate 28 and is held thereto by a central pin 36 which extends through boss 34. Clip 38, in the form of a cotter pin, passes through an opening 40 of pin 36 and functions as a retainer for boss 34, in the position shown in FIGS. 4 and 5. A plurality of bores 42 such extend into boss 34 at an angle which is oriented outwardly and backwardly from plate 28. Bore 44 represents the typical construction of any of the plurality of bores 42.

Frame member 46 is also found in the present invention. Frame member 46 includes a quartet of flexible rods 48, 50, 52, and 54 which are capable of entering any of the plurality of bores 42 and remaining thereat by a friction fit. With further reference to FIG. 4, it may be observed that plurality of rods 48, 50, 52, and 54 of frame member 46 extend outwardly and rearwardly from plate 28. FIG. 3 illustrates the full extension of plurality of rods 48, 50, 52, and 54 from boss 34.

Sheet or airfoil 56 fastens to the ends of rods 48, 50, 52, and 54. Sheet 56 is depicted in the drawings as having a trapezoidal-shape, however other shapes producing an air resistance would suffice. With reference to FIG. 6, it may be seen that fastening means 58 for holding sheet 56 to frame 46 is depicted with respect to rod 54. It may be apparent that fastening means 58 is also employed to hold sheet 56 to rods 48, 50, and 52. In this regard, rod 54 terminates in a cap 60 having a slot 62. Sheet 56 possesses a quartet of reinforced corners such as corner 64 having a protuberance such as ring 66 at the terminus thereof. Ring 66 fits in slot 62 and is held thereto by the flexing of rod 54. As noted in FIG. 3, 2 and 3, rods 48, 50, 52, and 54 possess a slight bow due to the sizing of sheet 56. Such bowing keeps sheet 56 under tension and permits the sheet to be affixed to frame 46.

Locking means 70 detachably connects sheet 56 to harness 12 by the use of boss 34, pin 36, and clip 38. Tether 72 extends forward to the user to permit the user to pull clip 72 from pin 36. At this point, boss 34 will slide from pin 36 such that sheet 56 is detached from harness 12.

In operation, the user assembles apparatus 10 by placing rods 48, 50, 52, and 54 within the bores 42 of boss 34, FIG. 4. Sheet 56 is then attached to the ends of rods 48, 50, 52, and 54 by the use of fastening means 58, FIG. 6. The user then straps harness 12 about his or her waist and cinches the same to a comfortable fit. The user 21 then moves by walking, jogging, cycling, and the like. Air resistance on sheet 56 subsequently produces a force against which the user must work. Such additional work, of course, adds to the exercise effort of user 21. Tether 72 may be yanked or pulled to immediately release sheet 56 from harness 12, as conditions dictate. It has been found that apparatus 10 permits the user 21 to exercise vigorously within a relatively small geographic perimeter, unlike the area required for normal walking, jogging, cycling, and the like.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An exercise apparatus for use by a person, comprising:

a. a harness intended for connections to the person, said harness having an inner surface adjacent the person, and an outer surface spaced from the person;

b. a boss including means for linking and extending said boss from said harness outer surface at the rear of the person connected to said harness;

c. a frame, including a multiplicity of elongated members, each of said multiplicity of elongated members being connectable to said boss for extension outwardly from said boss at the rear of the person in a certain direction to remain essentially free of the swinging arms of the person during travel of the person;

d. a sheet connected to each of said elongated members of said frame at a portion outwardly from said boss at the rear of the person said sheet being free of the swinging arms of the person and being capable of exerting a pulling force on said frame by air resistance upon movement of said harness when connected to a traveling person; and e. locking means for selectively holding and detaching said sheet to said harness.

2. The apparatus of claim 1 in which said boss includes a multiplicity of bores angled outwardly from said harness, and said multiplicity of elongated members are capable of being held in said multiplicity of bores such that said multiplicity of elongated members extend outwardly from said harness at the rear of the person.

3. The apparatus of claim 1 in which said locking means comprises a pin extending from said harness and extending through a portion of said boss, and a removable clip engaging said pin, said clip confining said boss to said pin.

4. The apparatus of claim 3 which additionally comprises a tether connected to said clip.

5. The apparatus of claim 1 in which said harness comprises a girth.

6. The apparatus of claim 1 in which said harness includes a plate and which further comprises means for releasably holding said boss to said plate.

7. The apparatus of claim 1 which additionally comprises fastening means for detachably connecting said sheet to said frame member, said fastening means including a slotted element formed on said frame and a protuberance extending from said sheet capable of engaging said slotted element.

* * * * *